US005664693A

United States Patent [19]

Krall

[11] Patent Number: 5,664,693

[45] Date of Patent: Sep. 9, 1997

[54] CHILD RESISTANT PACKAGE

[75] Inventor: Thomas J. Krall, Toledo, Ohio

[73] Assignee: Owens-Illinois Closure Inc., Toledo, Ohio

[21] Appl. No.: 653,810

[22] Filed: May 28, 1996

Related U.S. Application Data

[60] Continuation of Ser. No. 398,711, Mar. 6, 1995, abandoned, which is a division of Ser. No. 57,077, May 6, 1993, Pat. No. 5,394,999.

[51] Int. Cl.[6] ..... B65D 50/08

[52] U.S. Cl. ..... 215/209; 215/221

[58] Field of Search ..... 215/209, 216, 215/220, 221, 330, 217, 218, 219, 223

[56] References Cited

U.S. PATENT DOCUMENTS

| | | | |
|---|---|---|---|
| 3,700,133 | 10/1972 | Bagguley | 215/221 |
| 3,790,015 | 2/1974 | Imamura | 215/209 |
| 3,805,987 | 4/1974 | Horvath . | |
| 3,877,597 | 4/1975 | Montgomery et al. . | |
| 3,881,625 | 5/1975 | Landen | 215/221 |
| 3,884,379 | 5/1975 | Landen | 215/221 |
| 3,891,110 | 6/1975 | Gach . | |
| 3,892,326 | 7/1975 | Schneible | 215/216 X |
| 3,894,647 | 7/1975 | Montgomery . | |
| 3,895,730 | 7/1975 | Koehne et al. | 215/221 X |
| 3,902,620 | 9/1975 | McIntosh | 215/221 X |
| 3,967,745 | 7/1976 | Julian | 215/216 |
| 3,974,929 | 8/1976 | Montgomery . | |
| 4,002,259 | 1/1977 | Geiser . | |
| 4,036,385 | 7/1977 | Morris | 215/221 X |
| 4,103,797 | 8/1978 | Morris . | |
| 4,427,124 | 1/1984 | Marshall et al. | 215/216 |
| 4,464,316 | 8/1984 | Michaels | 215/216 X |
| 4,473,162 | 9/1984 | Donoghue | 215/209 |
| 4,511,049 | 4/1985 | Aboud | 215/216 |
| 5,230,433 | 7/1993 | Hamilton et al. | 215/221 |

*Primary Examiner*—Allan N. Shoap
*Assistant Examiner*—Nathan Newhouse

[57] ABSTRACT

A child resistant package including a plastic container having a finish with an external thread and a plastic closure having a base wall and an internal thread thereon for engaging the thread on the container. The container includes diametrically opposed integral tabs extending from the container. Each tab has substantially uniform thickness such that it is capable of flexing relative to said container. The skirt of the closure has a free edge with diametrically opposed projections thereon engagable by the radial tabs. The tabs are manually deflectable to disengage from said projections on the skirt to permit manual rotation of the closure to unthread said closure from the container. In one form, the tabs comprise a first portion extending radially outwardly and a second portion extending axially downwardly and the projections comprise axially extending projections on the inner surface of the skirt of the closure with notches on the skirt through which a finger of a user can be provided to deflect the area of juncture of the radial and axial portions of each tab from its respective projection. In another form, the tabs extend radially from the finish of the container and engage projections defined by notches in the peripheral skirt of the closure.

1 Claim, 3 Drawing Sheets

CHILD RESISTANT PACKAGE

This application is continuation, of application Ser. No. 08/398,711, filed Mar. 6, 1995, now abandoned which is a division of Ser. No. 08/057,077 filed May 6, 1993 now U.S. Pat. No. 5,394,999.

This invention relates to child resistant packages and particularly to plastic child resistant packages.

BACKGROUND AND SUMMARY OF THE INVENTION

Child resistant packages comprising a plastic closure and a plastic container are well known in the art as shown for example in the following U.S. Pat. Nos: 3,805,987; 3,877,595; 3,891,110; 3,894,647; 3,974,929; 4,002,259; 4,036,385 and 4,103,797.

Among the objectives of the present invention are to provide a child resistant package which utilizes a closure having deformable tabs and which are adapted to engage anti-rotation projection on the closure; which minimizes the number of parts used; wherein the closure and container can be made by well known processes; and wherein the package is relatively economical to make while maintaining the desired child resistant construction.

In accordance with the invention, a child resistant package including a plastic container having a finish with an external thread and a plastic closure having a base wall and an internal thread thereon for engaging the thread on the container. The container includes diametrically opposed integral tabs extending from the container. Each tab has substantially uniform thickness such that it is capable of flexing relative to said container. The skirt of the closure has a free edge with diametrically opposed projections thereon engagable by the radial tabs. The tabs are manually deflectable to disengage from said projections on the skirt to permit manual rotation of the closure to unthread said closure from the container. In one form, the tabs comprise a first portion extending radially outwardly and a second portion extending axially downwardly and the projections comprise axially extending projections on the inner surface of the skirt of the closure with notches on the skirt through which a finger of a user can be provided to deflect the area of juncture of the radial and axial portions of each tab from its respective projection. In another form, the tabs extend radially from the finish of the container and engage projections defined by notches in the peripheral skirt of the closure.

DESCRIPTION

Figure 1:
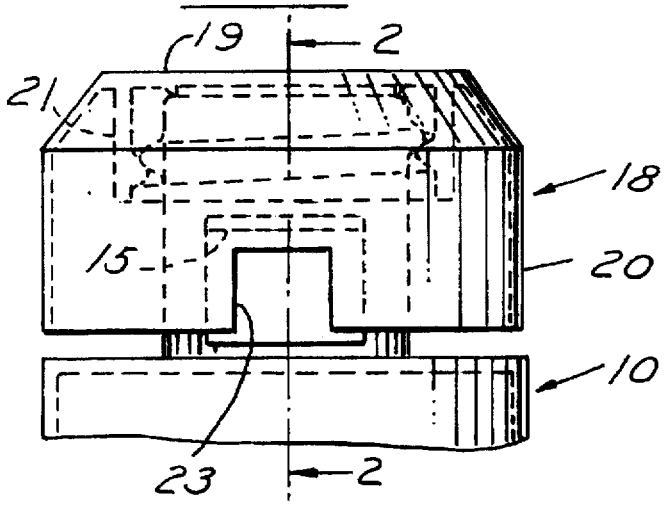
FIG. 1 is a fragmentary front elevational view of a child resistant package embodying the invention.
Figure 2:
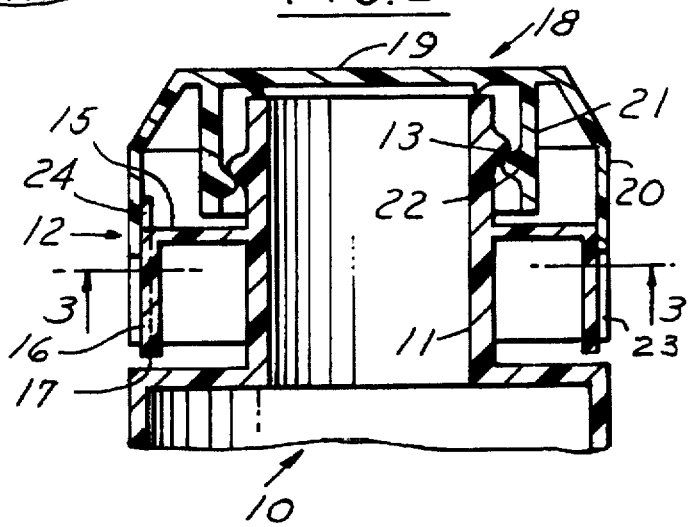
FIG. 2 is a fragmentary sectional view taken along the line 2—2 in FIG. 1.
Figure 3:
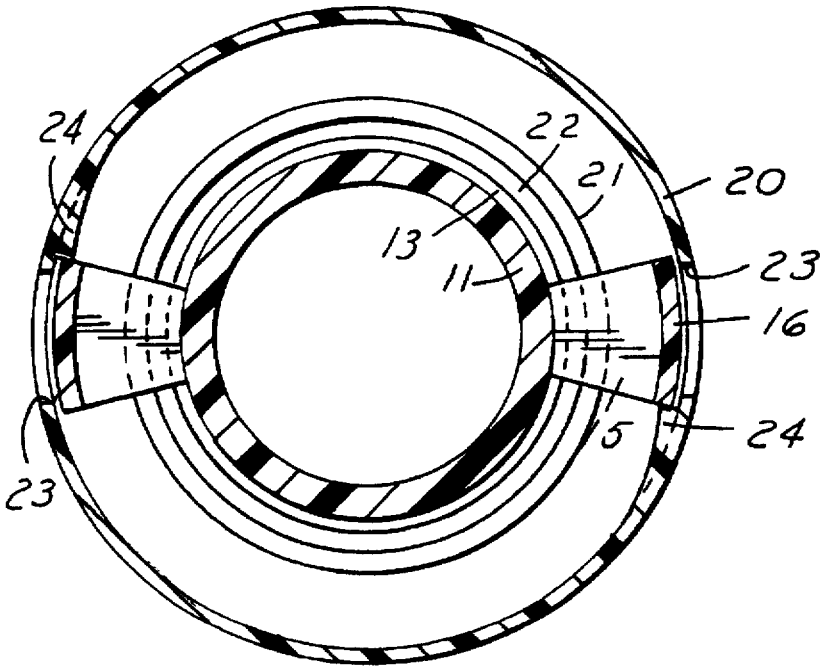
FIG. 3 is a sectional view taken along the line 3—3 in FIG. 2.
Figure 4:
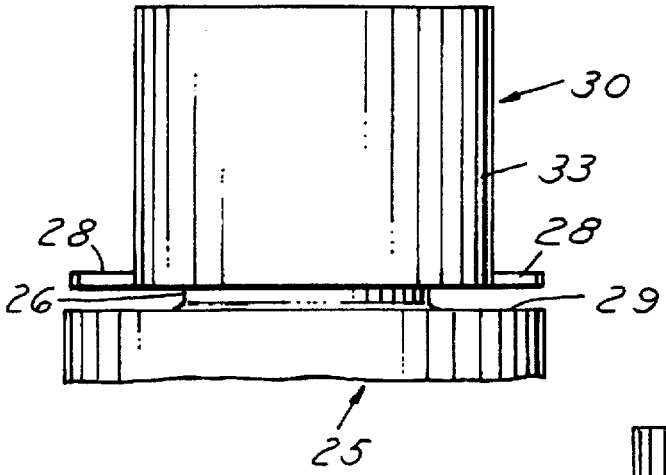
FIG. 4 is a fragmentary elevational view of a modified form of child resistant package.
Figure 5:
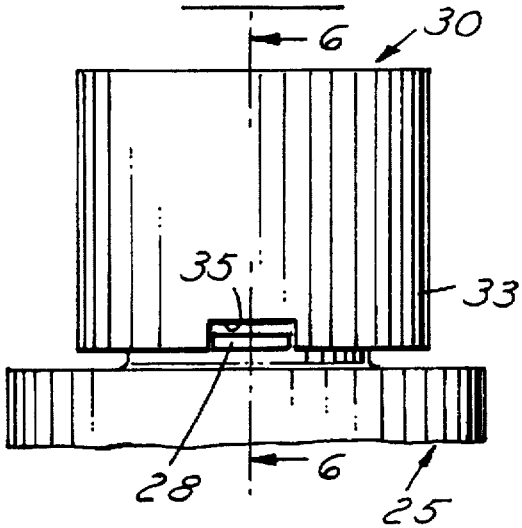
FIG. 5 is a side elevational view of the package shown in FIG. 4.
Figure 6:
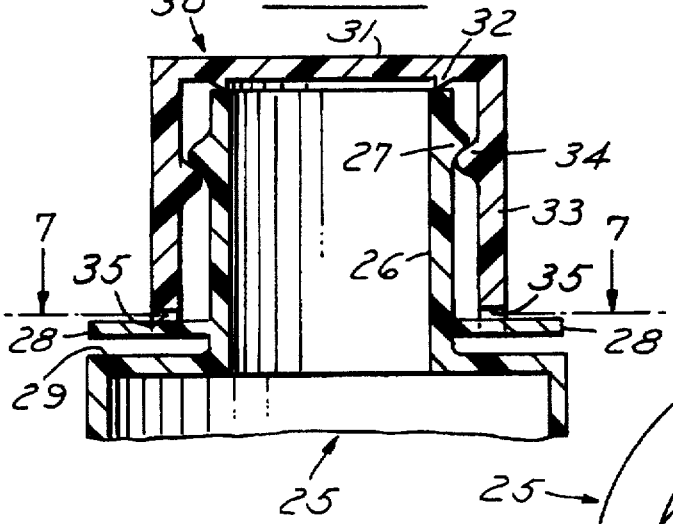
FIG. 6 is a fragmentary sectional view taken along the line 6—6 in FIG. 5.
Figure 7:
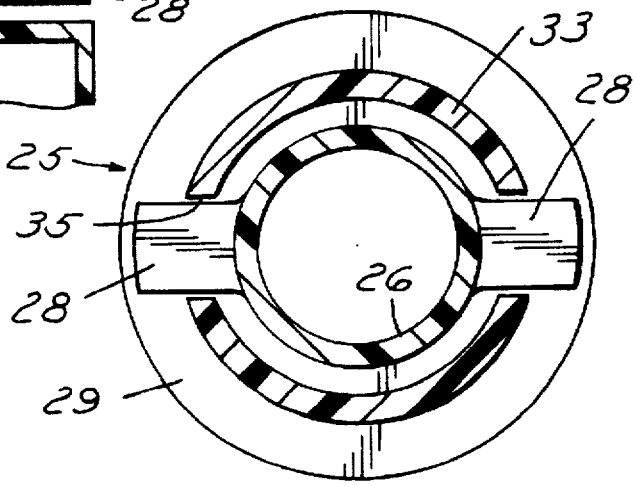
FIG. 7 is a sectional view taken along the line 7—7 in FIG. 6.
Figure 8:
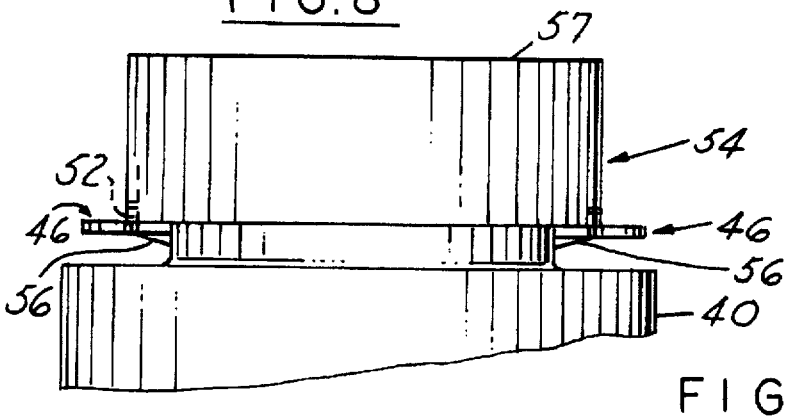
FIG. 8 is a fragmentary elevational view of a further modified form of package such as shown in FIG. 4.
Figure 9:
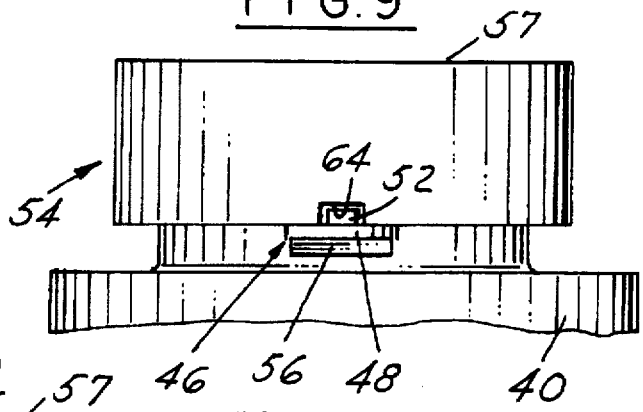
FIG. 9 is a side-elevational view of the package shown in FIG. 8.
Figure 10:
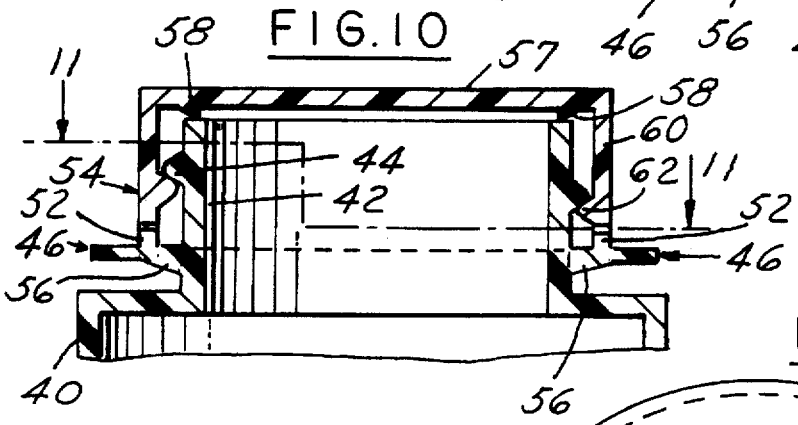
FIG. 10 is a vertical sectional view taken along the line 10—10 in FIG. 9.
Figure 11:
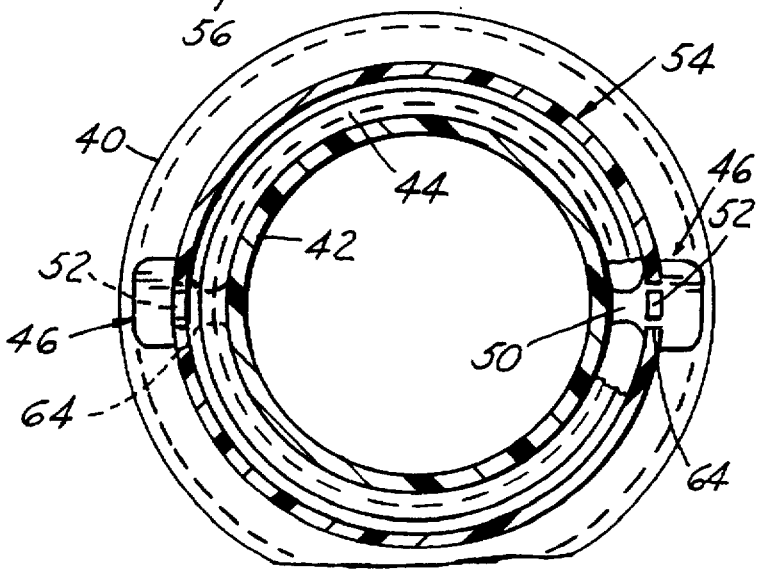
FIG. 11 is a sectional view taken along the lines 11—11 in FIG. 10.

Referring to FIGS. 1–3, in one form of child resistant package made in accordance with the invention, the package comprises a plastic container 10 having an integral finish 11 with diametrically opposed integral tab 12 extending radially outwardly from the neck below integral external threads 13. Each tab 12 includes an integral radial portion 15 and an axial portion 16 terminating axially in a free edge 17.

The package further includes a plastic closure 18 having a base wall 19 and a peripheral skirt 20. The closure 18 further includes an intermediate or inner wall 21 formed with an integral thread 22 on its inner surface engaging the external thread 13 on the finish 11 of the container.

The peripheral skirt 20 is provided with diametrically opposed axially extending notches 23. The skirt 20 further includes axially extending diametrically opposed anti-rotation projections 24 on its inner surface that are normally engaged by the radially outermost portion of the radial portion 15 of each tab 12.

When the closure 12 is threaded in clockwise fashion looking down on the closure, the tabs 12 deflect past the lugs 24 until the closure 18 is fully threaded on the container and the portions 16 of tabs 12 are aligned with notches 23. The lugs 24 being tapered in an anti-clockwise rotation as viewed in FIG. 3 function to maintain the closure on the container 10. When it is desired to remove the closure, the user grasps the closure pressing inwardly through notches 23 on the opposed tabs 12 to deflect them sufficiently so that the closure can be rotated after being disengaged from the lugs 24.

In the form shown in FIGS. 4–7, the container 25 includes a finish 26 having an external thread 27 and radially extending thin flat tabs 28 that lie in a radial plane intersecting the axis of the finish 26 and projecting radially outwardly from the finish 26 adjacent the upper end 29 of the container 25.

The plastic closure 30 includes a base wall 31 with an integral sealing lip 32 on its inner surface and a peripheral skirt 33 with an internal thread 34 for engaging the external thread 27 on the container 25. Notches 35 are provided in diametrically opposed relationship on the lower edge of the skirt 33 which receive the flexible are flexed downwardly by the free edge of the skirt 33 as the closure is being applied. The tabs 28 flex upwardly and engage the notches 35 when the closure is fully threaded on the container. When it is desired to remove the closure, the tabs 28 are flexed downwardly by the user disengaging from the notches 35 permitting rotation of the closure 30.

In the form shown in FIGS. 8–11, the container 40 includes a finish 42 having an external thread 44 and integral radially extending thin flat tabs 46 that lie in a radial plane intersecting the axis of the finish 42 and projecting radially outwardly from the finish 42 adjacent the upper end of the container 40. Each tab 46 includes a circumferentially enlarged portion 48 connected to the finish 42 by a narrow portion 50. Each enlarged portion 48 has an upstanding projection 52 which is positioned adjacent the outer surface of the closure 54, as presently described. Each tab 46 includes an integral gusset 56 on the underside thereof providing limited axial bending of the tab.

The plastic closure 54 includes a base wall 57 with an integral sealing lip 58 on its inner surface and a peripheral skirt 60 with an internal thread 62 for engaging the external thread 44 on the container 40. Notches 64 are provided in diametrically opposed relationship on the lower edge of the skirt 60 which are flexed downwardly by the free edge on the skirt 60 as the closure is being applied. The narrow portions 50 of tabs 46 flex upwardly and cause the projections 52 to engage the notches 64 when the closure is fully threaded on the container. When it is desired to remove the closure, the tabs 46 are flexed downwardly by the user disengaging the projections 52 from the notches 64 permitting rotation of the closure 54.

The containers 10, 25, 40 may be made of any suitable plastic such as polypropylene or polyethylene. The closures may also be made of polypropylene or polyethylene.

It can thus be seen that there has been provided a child resistant package which utilizes a closure having deformable tabs and which are adapted to engage anti-rotation projection on the closure; which minimizes the number of parts used; wherein the closure and container can be made by well known processes; and wherein the package is relatively economical to make while maintaining the desired child resistant construction.

What is claimed is:

1. A child resistant packaging including a plastic container having a finish having an external thread, and a plastic closure having a base wall and a peripheral skirt having an internal thread thereon for engaging the thread on the container, said container including two diametrically opposed integral flat tabs extending from the container, said tabs in the unstressed condition lying in a radial plane intersecting the axis of the finish, each tab having substantially uniform axial thickness throughout such that it is capable of flexing downwardly relative to said container defining a top surface and a lower surface, each said flat tab including an enlarged circumferentially extending free end portion connected to the finish by a narrow portion, said enlarged circumferentially extending free end extends longer than said narrow portion in the circumferential direction, said tab including an axial projection which is rectangular in a circumferential direction on the top surface of each said enlarged free end tab, a radial gusset extending downwardly from the lower surface of each said tab and extending to said finish of said container thereby modifying the flexibility of said tabby limiting the axial downward bending of said tab, said closure having a base wall and a peripheral skirt, said skirt having a free edge with two diametrically opposed symmetrical rectangular notches in said free edge, the width of said axial projection on each said tab being greater than the width of said notch in a circumferential direction, the width of the enlarged portion of each said tab being greater than the width of each said notch, the axial height of said projections being less than the height of said notches, said closure being positioned relative to the finish of the container such that as the closure is rotated to apply the closure to the container, the skirt of the closure engages the enlarged portions of said tabs and flexes said tabs downwardly until the notches are in overlying relation to said axial projections on said tabs such that the tabs flex upwardly into engagement with said notches and said enlarged portions of said tabs engage the skirt of the closure, said tabs being manually deflectable downwardly to disengage said projections on said tabs from said notches on said skirt of the closure to permit manual rotation of the closure to unthread said closure from the container.

* * * * *